US008700221B2

(12) United States Patent
Cheng et al.

(10) Patent No.: US 8,700,221 B2
(45) Date of Patent: Apr. 15, 2014

(54) METHOD AND APPARATUS FOR PUMP CONTROL USING VARYING EQUIVALENT SYSTEM CHARACTERISTIC CURVE, AKA AN ADAPTIVE CONTROL CURVE

(75) Inventors: Andrew A. Cheng, Wilmette, IL (US); James J. Gu, Buffalo Grove, IL (US)

(73) Assignee: Fluid Handling LLC, Morton Grove, IL (US)

( * ) Notice: Subject to any disclaimer, the term of this patent is extended or adjusted under 35 U.S.C. 154(b) by 218 days.

(21) Appl. No.: 12/982,286

(22) Filed: Dec. 30, 2010

(65) Prior Publication Data

US 2012/0173027 A1 Jul. 5, 2012

(51) Int. Cl.
*G05D 11/00* (2006.01)

(52) U.S. Cl.
USPC ..... 700/282; 370/241; 165/157

(58) Field of Classification Search
USPC ..... 700/282; 370/241; 165/157
See application file for complete search history.

(56) References Cited

U.S. PATENT DOCUMENTS

| | | | |
|---|---|---|---|
| 4,490,094 | A | 12/1984 | Gibbs |
| 4,708,594 | A | 11/1987 | Shinmei et al. |
| 4,897,798 | A | 1/1990 | Cler |
| 5,069,792 | A | 12/1991 | Prince et al. |
| 5,318,409 | A | 6/1994 | London et al. |
| 5,555,749 | A | 9/1996 | Wehrman et al. |
| 5,615,996 | A | 4/1997 | Suzuki et al. |
| 5,651,264 | A | 7/1997 | Lo et al. |
| 5,817,950 | A | 10/1998 | Wiklund et al. |
| 5,911,238 | A | 6/1999 | Bump et al. |
| 5,991,525 | A | 11/1999 | Shah et al. |
| 5,997,778 | A | 12/1999 | Bulgrin |
| 6,114,670 | A | 9/2000 | Erickson et al. |

(Continued)

FOREIGN PATENT DOCUMENTS

| | | |
|---|---|---|
| JP | 56096189 | 8/1981 |
| WO | 8602858 | 5/1986 |

(Continued)

OTHER PUBLICATIONS

JP56096189 English Language Abstract (1 page).

(Continued)

*Primary Examiner* — Mohammad Ali
*Assistant Examiner* — Anthony Whittington

(57) ABSTRACT

The present invention provides, e.g., apparatus comprising at least one processor; at least one memory including computer program code; the at least one memory and computer program code being configured, with at least one processor, to cause the apparatus at least to: respond to signaling containing information about an instant pressure and a flow rate of fluid being pumped in a pumping system, and obtain an adaptive control curve based at least partly on the instant pressure and flow rate using an adaptive moving average filter. The adaptive moving average filter may be based at least partly on a system flow equation:

$$SAMA_t = AMAF(Q_t/\sqrt{\Delta P_t}),$$

where the function AMAF is an adaptive moving average filter (AMAF), and the parameters Q and ΔP are a system flow rate and differential pressure respectively. The at least one memory and computer program code may be configured to, with the at least one processor, to cause the apparatus at least to obtain an optimal control pressure set point from the adaptive control curve with respect to an instant flow rate or a moving average flow rate as $$SP_t = MA(Q_t)/SAMA_t,$$

where the function MA is a moving average filter (MA), to obtain a desired pump speed through a PID control.

22 Claims, 5 Drawing Sheets

(56) References Cited

U.S. PATENT DOCUMENTS

| | | | | |
|---|---|---|---|---|
| 6,142,228 | A | 11/2000 | Jogi et al. | |
| 6,234,759 | B1 | 5/2001 | Hennel et al. | |
| 6,241,485 | B1 | 6/2001 | Warwick | |
| 6,324,490 | B1 | 11/2001 | Johansson et al. | |
| 6,332,463 | B1 | 12/2001 | Farrugia et al. | |
| 6,350,105 | B1 | 2/2002 | Kobayashi et al. | |
| 6,532,423 | B2 | 3/2003 | Chen et al. | |
| 6,663,349 | B1 | 12/2003 | Discenzo et al. | |
| 6,725,167 | B2 | 4/2004 | Grumstrup et al. | |
| 6,758,655 | B2 | 7/2004 | Sacher | |
| 6,775,595 | B1 | 8/2004 | Yabutani et al. | |
| 6,862,405 | B2 | 3/2005 | Malinoski et al. | |
| 6,939,109 | B2 | 9/2005 | Takahashi et al. | |
| 7,033,147 | B2 | 4/2006 | Yanai et al. | |
| 7,082,374 | B2 | 7/2006 | Ranta | |
| 7,163,001 | B2 | 1/2007 | Jung et al. | |
| 7,261,167 | B2 | 8/2007 | Goldman et al. | |
| 7,267,086 | B2 | 9/2007 | Allen et al. | |
| 7,336,168 | B2 | 2/2008 | Kates | |
| 7,396,327 | B2 | 7/2008 | Morello | |
| 7,455,099 | B2 | 11/2008 | Osborn et al. | |
| 7,552,033 | B1 | 6/2009 | Culp et al. | |
| 7,558,699 | B2 | 7/2009 | Beck et al. | |
| 7,630,580 | B1 | 12/2009 | Repenning | |
| 7,668,694 | B2 | 2/2010 | Anderson et al. | |
| 7,720,574 | B1 | 5/2010 | Roys | |
| 7,734,441 | B2 | 6/2010 | Taravat et al. | |
| 7,845,913 | B2 | 12/2010 | Stiles, Jr. et al. | |
| 2001/0025146 | A1* | 9/2001 | Maloney et al. | 600/546 |
| 2003/0057904 | A1 | 3/2003 | Sacher | |
| 2003/0063978 | A1 | 4/2003 | Takahashi et al. | |
| 2004/0013531 | A1 | 1/2004 | Curry et al. | |
| 2005/0025628 | A1 | 2/2005 | Jones | |
| 2005/0105471 | A1* | 5/2005 | Ido et al. | 370/241 |
| 2005/0123408 | A1 | 6/2005 | Koehl | |
| 2005/0125104 | A1 | 6/2005 | Wilson et al. | |
| 2005/0133211 | A1* | 6/2005 | Osborn et al. | 165/157 |
| 2005/0216242 | A1 | 9/2005 | Flax et al. | |
| 2006/0095163 | A1* | 5/2006 | Wear et al. | 700/282 |
| 2007/0065304 | A1 | 3/2007 | Meloche et al. | |
| 2007/0212210 | A1 | 9/2007 | Kernan et al. | |
| 2007/0288103 | A1* | 12/2007 | Choudhury et al. | 700/35 |
| 2008/0187443 | A1 | 8/2008 | Aguilar et al. | |
| 2008/0288115 | A1 | 11/2008 | Rusnak et al. | |
| 2009/0094173 | A1 | 4/2009 | Smith et al. | |
| 2009/0129935 | A1* | 5/2009 | Kunkler et al. | 417/1 |
| 2009/0129941 | A1* | 5/2009 | Haas | 417/42 |
| 2009/0132458 | A1 | 5/2009 | Edwards et al. | |
| 2009/0204234 | A1* | 8/2009 | Sustaeta et al. | 700/29 |
| 2009/0210081 | A1* | 8/2009 | Sustaeta et al. | 700/99 |
| 2009/0250264 | A1 | 10/2009 | Dupriest | |
| 2009/0281671 | A1* | 11/2009 | Duan et al. | 700/282 |
| 2010/0010681 | A1* | 1/2010 | Zugibe et al. | 700/282 |
| 2010/0028171 | A1 | 2/2010 | Shulver et al. | |
| 2010/0049480 | A1 | 2/2010 | Pekar et al. | |
| 2010/0140934 | A1 | 6/2010 | Nicoson | |
| 2010/0150737 | A1 | 6/2010 | Anderson et al. | |
| 2010/0306001 | A1* | 12/2010 | Discenzo et al. | 705/7 |
| 2011/0032527 | A1* | 2/2011 | Chan | 356/445 |
| 2011/0081255 | A1* | 4/2011 | Steger et al. | 417/44.1 |
| 2011/0153237 | A1 | 6/2011 | Jonsson et al. | |
| 2011/0206537 | A1 | 8/2011 | Simpson | |
| 2011/0255992 | A1* | 10/2011 | Tran et al. | 417/1 |
| 2011/0301766 | A1 | 12/2011 | Higgins et al. | |
| 2012/0000189 | A1* | 1/2012 | Wang et al. | 60/286 |

FOREIGN PATENT DOCUMENTS

| | | |
|---|---|---|
| WO | 9200769 | 1/1992 |
| WO | 9910783 | 3/1999 |
| WO | 2005115539 | 12/2005 |
| WO | 2006047826 | 5/2006 |
| WO | 2006097199 | 9/2006 |

OTHER PUBLICATIONS

Abstract for EP1761306 not available, Abstract for corresponding US2005267322 attached.

* cited by examiner

Figure 1a: A primary variable speed pump control system

Figure 1b: A secondary variable speed pump control system.

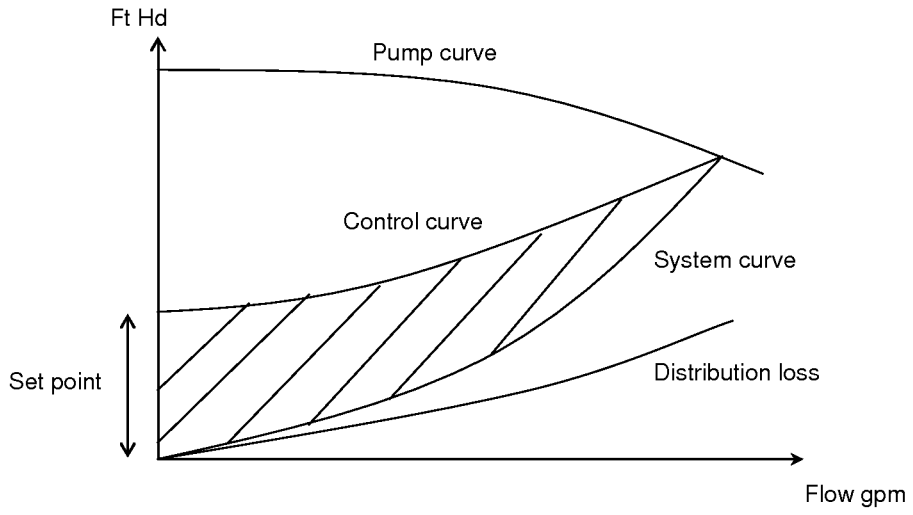
Figure 2 (Prior art): An equivalent system characteristics curve and control curve.
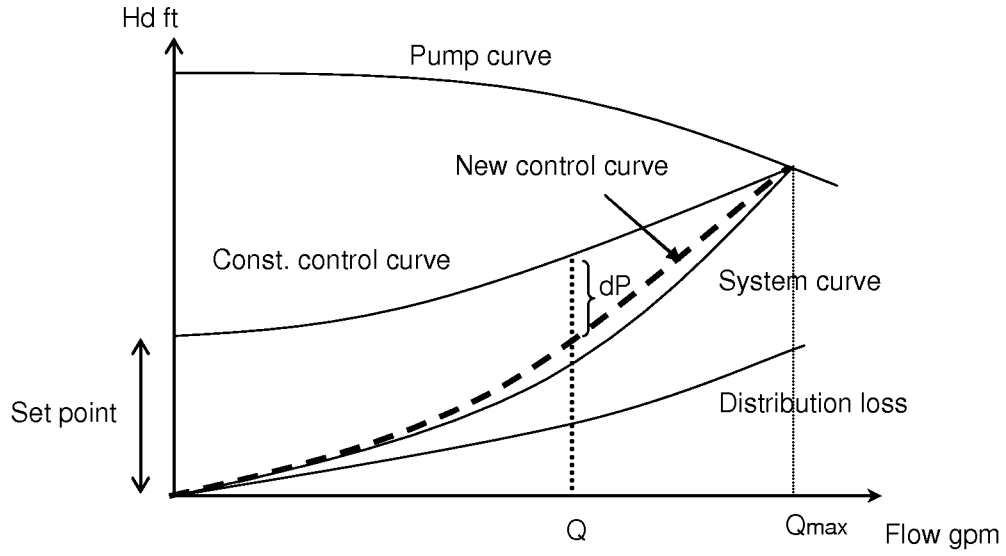
Figure 3a: A new control set point curve approach, with which hydronic power that may be saved equals dp*Q at flow rate Q.

Pump System 5

Apparatus 10, including a pump controller,

At least one processor 12 and at least one memory 14 including computer program code; the at least one memory 14 and computer program code configured, with at least one processor 12, to cause the apparatus at least to:

respond to signaling containing information about an instant pressure and a flow rate of fluid being pumped in a pumping system, obtain a varying equivalent system characteristic curve, also referred to as an adaptive control curve, based at least partly on the instant pressure and flow rate using an adaptive moving average filter, and set up a control set point for a system process variable from the adaptive control curve to obtain a desired pump speed through a proportional integral derivative (PID) control Pump and other pump-related modules 16, including either at least one input processor 18 configured to cause the apparatus 10 at least to receive process variable signals, including the signaling containing information about the instant pressure and the flow rate of fluid being pumped in the pumping system; or at least one output processor 20 configured to cause the apparatus 10 at least to provide a pump motor drive speed signal based at least partly on the control set point for the system process variable from the adaptive control curve, or a combination thereof

Figure 3

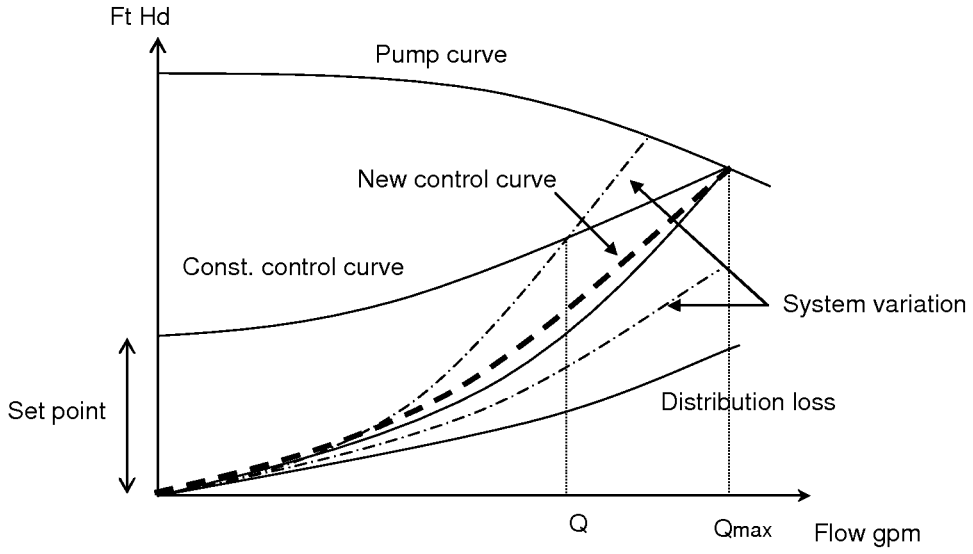
Figure 4. System characteristics variation to meet the flow rate requirement.
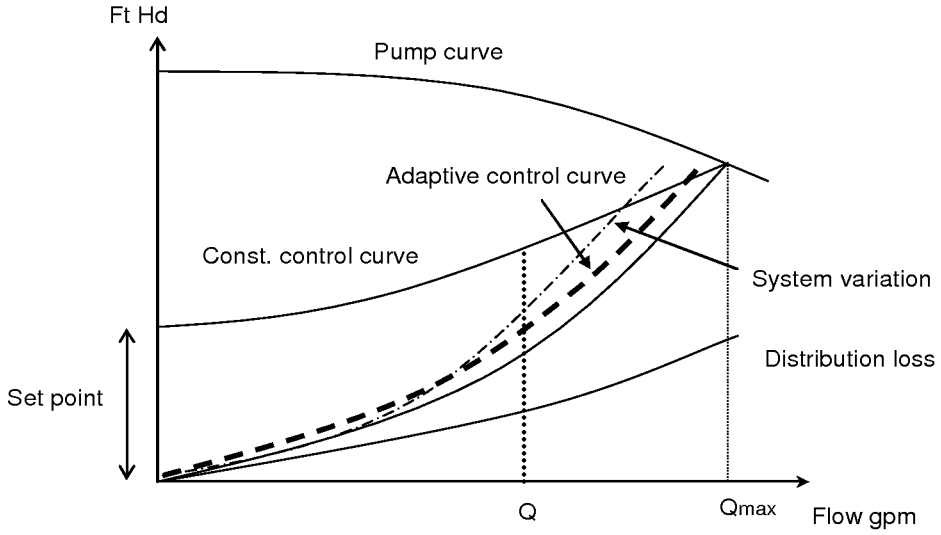
Figure 5: Adaptive control curve and means by using adaptive filtering technologies.

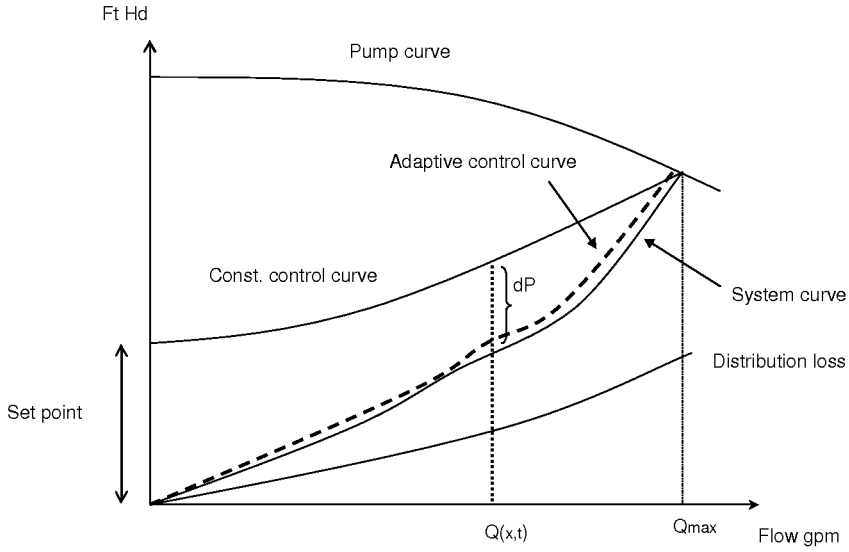
Figure. 6: Adaptive curve for a 2D system distribution characteristics, where the differential pressure is a function of flow rate $Q(x,t)$ with flow rate percentage x and time t.

METHOD AND APPARATUS FOR PUMP CONTROL USING VARYING EQUIVALENT SYSTEM CHARACTERISTIC CURVE, AKA AN ADAPTIVE CONTROL CURVE

BACKGROUND OF THE INVENTION

1. Field of the Invention

The present invention relates to a technique for controlling the operation of a pump; and more particularly, the present invention relates to a method and apparatus for controlling the speed of a pump, e.g., for domestic and commercial heating or cooling water systems.

2. Brief Description of Related Art

Current techniques on variable speed pump controls for domestic and commercial heating or cooling water systems are based upon a proportional integral derivative (PID) control algorithm with respect to a system differential pressure verses a constant pressure set point. Some other control parameters may also include flow rate, power and so forth. A typical water heating or cooling hydronic system is shown below schematically in FIG. 1, including FIGS. 1*a* and 1*b*. The corresponding system curve and control curve for a balanced system are shown below schematically in FIG. 2. The constant set point control method that is currently used in the pump control system is very simple and has been applied successfully for cooling and heating water supply applications for many years.

The pump control community has recently noted, however, that quite an amount of operation energy required to run pumps by using this method is wasted due to the pressure point being set much higher than the actual system pressure needed actually to meet the flow requested at the time, which is indicated by the shaded area in FIG. 2 above.

Recently, issues regarding energy saving and environmental protection have been addressed dramatically and significantly. More attention has been paid to all control applications, includes pump controls for domestic and commercial heating or cooling water systems. In order to reduce energy consumption and operation costs, some innovations to the current pump control method may need to be made.

SUMMARY OF THE INVENTION

According to some embodiments, the present invention may take the form of apparatus, such as a pump controller, featuring at least one processor; at least one memory including computer program code; the at least one memory and computer program code configured, with the at least one processor, to cause the apparatus at least to:

- respond to signaling containing information about an instant pressure and a flow rate of fluid being pumped in a pumping system,
- obtain a varying equivalent system characteristic curve, also referred to herein as an adaptive control curve, based at least partly on the instant pressure and flow rate using an adaptive moving average filter, and
- set up a control set point for a system process variable from the adaptive control curve to obtain a desired pump speed through a pump controller, such as a proportional integral derivative (PID) control.

Embodiments of the present invention may also include one or more of the following features: The apparatus may further comprise at least one input processor configured to cause the apparatus at least to process variable signals, including the signaling containing information about the instant pressure and the flow rate of fluid being pumped in the pumping system; or at least one output processor configured to cause the apparatus at least to provide a pump motor drive speed signal based at least partly on the control set point for the system process variable from the adaptive control curve, or a combination thereof. The adaptive control curve, $SAMA_t$, may, e.g., be based at least partly on a system flow equation:

$$SAMA_t = AMAF(Q_t/\sqrt{\Delta P_t}),$$

where the function AMAF is an adaptive moving average filter function (AMAF), and the parameters Q and ΔP are a system flow rate and differential pressure respectively. The at least one memory and computer program code may, e.g., be configured, with the at least one processor, to cause the apparatus at least to obtain an optimal control pressure set point from the adaptive control curve with respect to an instant flow rate or a moving average flow rate as $$SP_t = MA(Q_t)/SAMA_t,$$

where the function MA is a moving average filter function (MA). The adaptive moving average filter function may, e.g., include using a moving average filter function (MA) or an adaptive moving average filter function to obtain the varying equivalent system curve or the adaptive control curve, respectively, as well as other types or kinds of filter functions either now know or later developed in the future. The at least one memory and computer program code may also, e.g., be configured, with the at least one processor, to cause the apparatus at least to obtain pump speed using a PID control with the instant system pressure versus the set point obtained from the adaptive control curve. The at least one memory and computer program code may also, e.g., be configured, with at least one processor, to cause the apparatus at least to include a threshold at beginning of the adaptive control curve for accommodating a pump initial speed. The apparatus may, e.g., form part of a PID controller, including for use in such a heating and cooling water system, as well as other types or kinds of fluid processing systems either now known or later developed in the future. By way of example, the apparatus may, e.g., form part of a primary control system or a secondary control system. The signaling for obtaining the adaptive control curve may, e.g., include input processing control signals containing information about system or zone pressures or differential pressures together with system or zone flow rates, or other derivative signals, including as power or torsion.

The apparatus may also, e.g., take the form of a controller or pump controller featuring the at least one signal processor and the at least one memory device including computer program code, where the at least one memory device and the computer program code may, e.g., be configured, with the at least one processor, to cause the controller at least to implement the functionality of the apparatus set forth above. Embodiments of the controller may, e.g., include one or more of the features described herein. The controller may also, e.g., form part of a pumping system or arrangement that includes the pump.

The present invention may also, e.g., take the form of a method featuring steps for controlling the pump, including responding to signaling containing information about the instant pressure and the flow rate of fluid being pumped in the pumping system, obtaining the adaptive control curve based at least partly on the instant pressure and flow rate using an adaptive moving average filter, and setting up a control set point for a system process variable from the adaptive control curve to obtain a desired pump speed through a pump controller, such as a proportional integral derivative (PID) control. Embodiments of the method may, e.g., include other steps for implementing one or more of the features described herein.

The present invention may also, e.g., take the form of a computer program product having a computer readable medium with a computer executable code embedded therein for implementing the method when run on a signaling processing device that forms part of such a pump controller. By way of example, the computer program product may, e.g., take the form of a CD, a floppy disk, a memory stick, a memory card, as well as other types or kind of memory devices that may store such a computer executable code on such a computer readable medium either now known or later developed in the future.

One advantage of the present invention is that it can contribute to the overall reduction of energy consumption and operation costs.

BRIEF DESCRIPTION OF THE DRAWING

The drawing includes the following Figures, not drawn to scale:

FIG. 1*a* is a diagram of a primary variable speed control pump system that is known in the art; and where FIG. 1*b* is a diagram of a primary variable speed control pump system that is also known in the art.

FIG. 2 is a graph of an equivalent system characteristic curve and control curve that is known in the art.

FIG. 3 is a block diagram of a pump system having apparatus configured to implement the functionality of some embodiments of the present invention.

FIG. 3*a* is a graph of a new control set point curve of foot head versus flow (gpm) according to some embodiments of the present invention.

FIG. 4 is a graph of system characteristics variations of foot head versus flow (gpm) according to some embodiments of the present invention.

FIG. 5 is a graph of an adaptive control curve of foot head versus flow (gpm) according to some embodiments of the present invention.

FIG. 6 is a graph of an adaptive control curve for a 2D system distribution characteristics of foot head versus flow (gpm), where the differential pressure is a function of flow rate Q(x,t) with flow rate percentage x and time t, according to some embodiments of the present invention.

DETAILED DESCRIPTION OF THE INVENTION

Figure 1:
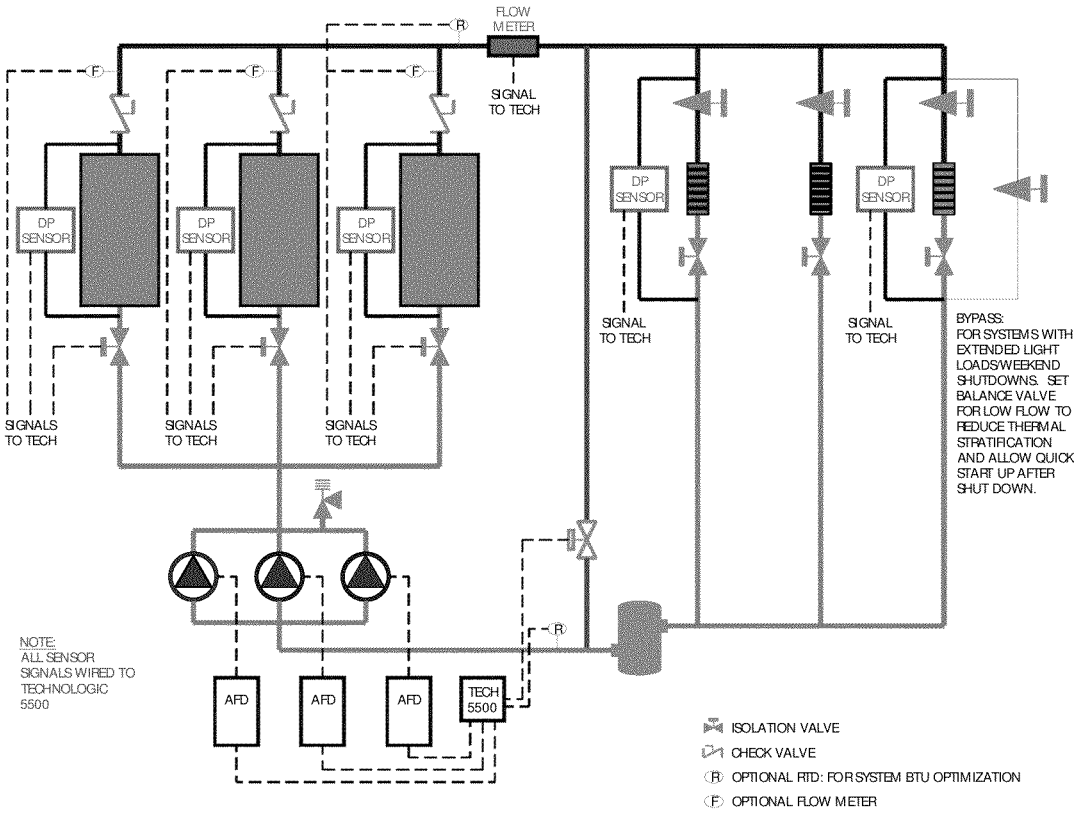
Figure 1 (Prior Art)
FIG. 1 includes FIGS. 1*a* and 1*b*, where
Figure 1:
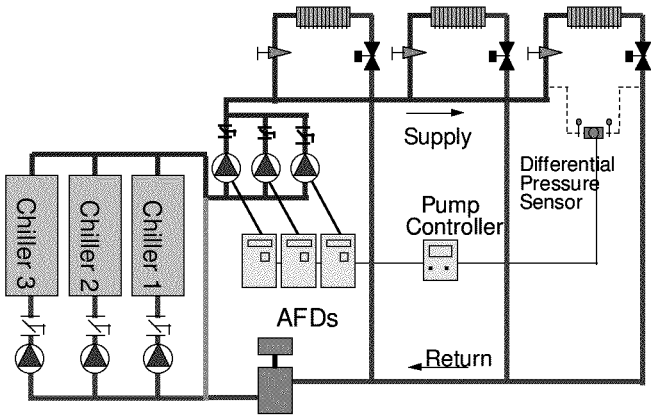
Figure 1 (Prior Art)

FIG. 3 shows the present invention in the form of apparatus 10, such as a pump controller, featuring at least one processor 12 and at least one memory 14 including computer program code, where the at least one memory 14 and computer program code are configured, with the at least one processor 12, to cause the apparatus at least to respond to signaling containing information about an instant pressure and a flow rate of fluid being pumped in a pumping system, obtain a varying equivalent system characteristic curve, also referred to herein as an adaptive control curve, based at least partly on the instant pressure and flow rate using an adaptive moving average filter, and set up a control set point for a system process variable from the adaptive control curve to obtain a desired pump speed through a pump controller, such as a PID control. As shown, the apparatus 10 forms part of a pump system 5 also having a pump and one or more other pump-related modules 16. By way of example, the pump system 5 may take the form of a domestic and commercial heating or cooling water system, consistent with that described herein. The scope of the invention is intended to include domestic and commercial heating or cooling water systems both now known and later developed in the future. Furthermore, the present invention is described by way of example in relation to implementing the same using a pump controller such as a PID control or controller. PID controls or controllers are known in the art, and the scope of the invention is not intended to be limited to any particular type or kind thereof, including PID control or controller technology both now known and later developed in the future. Based on the disclosure herein, one skilled in the art would be able to implement the functionality of the present associated using such a PID control or controller without undue experimentation. Moreover, the scope of the invention is intended to include implementing the present invention using other types or kinds of controls or controllers both now known or later developed in the future.

The one or more other pump-related modules 16 may also include either at least one input processor 18 configured to cause the apparatus 10 at least to receive process variable signals, including the signaling containing information about the instant pressure and the flow rate of fluid being pumped in the pumping system 5; or at least one output processor 20 configured to cause the apparatus 10 at least to provide a pump motor drive speed signal based at least partly on the control set point for the system process variable from the adaptive control curve; or the combination of at least one input processor 18 and the at least one output processor 20.

In effect, the apparatus 10 according to the present invention is configured to provide a new technique or approach to control a pump by means of a set point curve, instead of a constant set point, as the control curve and means for the pump's control of domestic and commercial heating or cooling water systems, consistent with that shown schematically in FIG. 3*a*, where a new control set point curve approach is demonstrated, by which hydronic power that is saved equals dp*Q at flow rate Q. With this new approach, the function for the control curve is substantially closer to the system curve designed and the operation energy wasted on pump control, the shaded area in FIG. 2, may be reduced. By way of example, 5 to 10% of operation energy may be saved if pumps are operated under the control technique according to the present invention.

The new control set point curve method set forth herein according to the present invention may be used for achieving substantially optimal control in accordance with any system characteristics to reduce operation costs and save energy. Similar to the known constant set point case, however, it is not self-adjustable in nature, while the system characteristics may vary from time to time due to the control valves position change to meet the flow rate requirement at the set point, consistent with that shown in FIG. 4. To make it work well, the apparatus 10 may be configured to choose the control curve that covers the system's utmost operation scenarios.

The present invention also provides a control technique that can be used to trace up the varying system characteristics and to set up the control set point accordingly to meet the flow rate requirement. If achievable, pumps are under the control of an adaptive set point curve with respect to varying system characteristics in a self-calibrating manner. System operation costs may be reduced and energy may be saved accordingly.

One preferred version of the set point curves and means for pump control for domestic and commercial heating or cooling water systems may include an adaptive control curve and technique which traces up the instant varying system characteristic by using adaptive filter technologies and sets up the control set point accordingly, consistent with that shown in FIG. 5 schematically. As shown, the adaptive control curve, $SAMA_t$, can be obtained from the instant pressure and flow rate signals through an adaptive moving average filter based upon the system flow equation in a self-calibrating manner as $$SAMA_t = AMAF(\sqrt{\Delta P_t}/Q_t), \quad (1)$$

where the function AMAF is an adaptive moving average filter function, and Q and ΔP are instant system flow rate and differential pressure respectively.

The optimal control pressure set point can be obtained from the adaptive control curve with respect to the instant flow rate or a moving average flow rate as $$SP_t = MA(Q_t)*SAMA_t + b, \quad (2)$$

where the function MA is a moving average filter function (MA) and the parameter b is a small constant pressure offset. Noted that the function AMAF could also be replaced by a moving average filter function (MA) or any other similar adaptive filters, respectively, either now known or later developed in the future. The scope of the invention is not intended to be limited to the type or kind of filter function. See FIG. 5, showing an adaptive control curve and technique for using adaptive filtering technologies according to the present invention. The adaptive control curves and technique for pump control for domestic and commercial heating or cooling water systems according to the present invention may also include a threshold at the beginning of the control curve for accommodating pump minimum speed.

For a system with arbitrary distribution characteristics of which the differential pressure P(x,t) is a function of flow rate Q(x,t) with flow rate percentage x and time t, shown in FIG. 6, the adaptive control curve and the set point may then be rewritten as $$SAMA_{x,t} = AMAF(\sqrt{\Delta P_{x,t}}/Q_{x,t}), \quad (3)$$

and $$SP_{x,t} = MA(Q_{x,t})*SAMA_{x,t} + b. \quad (4)$$

Here, the function AMAF is a 2D adaptive moving average filter with respect to an instant system flow rate percentage x and time t, respectively.

As described previously, the equations of the adaptive control curve presented above can be used to trace up a varying system characteristics and to set up the control setting point accordingly. The pump's speed can then be obtained from a PID control with respect to the set point derived and the instant system pressure.

In general, for a system configured with only automatic controlled circulators, there is no significant system characteristics variation in operation. In other words, the system is almost persistent in nature. The system characteristics change occurs only when a zone or a sub-system is shut off or turned on, due to the piping distribution friction loss in system.

For a system with some automatic control valves, however, the system characteristics is generally dynamic in nature. The system characteristics may vary when any of those control valves in system changes its position with respect to any temperature change. The variation may also happen when any sub-system or zone in a building shuts off or turns on for a some period of time, for instance.

Since an adaptive moving average filter is used to subtract the adaptive control curve, the sensitivity of the control curve variation to any instant system characteristics change may be related closely with the signals sampling time and the filter length. The longer the filter length and sampling time, the smaller and slower response the adaptive control curve to any instant system change. To satisfy a flow rate requested specifically, therefore, the adaptive control curve may lay itself somewhere in between the constant set point control curve and the pipeline distribution friction loss curve consistent with that shown in FIG. 5 or 6, where the constant set point may be used as the upper limit.

Ideally, the adaptive control curve obtained may be around the system curve at its balanced position and a little insensitive to any instant or a short term system characteristics change, while it is still capable of tracking a long term system characteristics change to meet the flow rate requirement in the system primarily. It is important and necessary to have a slow and small response requirement on the adaptive control curve in order to save energy in comparison with the conventional constant set point approach. The smaller and slower response the adaptive control curve to any instant system characteristics changes, and the larger difference in between the constant set point control curve and the adaptive control curve, the more energy may be saved.

The adaptive control curve proposed here can be used not only in a primary control system but a secondary control system as well.

The zones, sub-systems or systems mentioned here for domestic and commercial heating or cooling water systems may include: control valves with automatic and manual control; circulators with automatic and manual control; control valves as well as circulators mention above; multiple zones with the control valves and circulators combinations.

The input processing control signals for obtaining adaptive set point curve may include, e.g.: system or zone pressures or differential pressures together with system or zone flow rates signals, or some other derivative signals, such as, pump speed, power, torsion, and so on.

The pumps mentioned here for domestic and commercial heating or cooling water systems includes: a single pump; a group of parallel ganged pumps; a group of serial ganged pumps; the combinations of parallel and serial ganged pumps.

By following the control set point curves proposed according to some embodiments of the present invention, the same staging and destaging pump means as those on the current control systems can be used directly, by following superposition principles with a headed pump system.

Running multiple pumps at lower staging and destaging speeds may also save more energy. One example is to set staging speed around 65% and destaging speed around 55% of its full speed, for which, about 5% to 20% hydronic energy may be saved, if running 2 pumps instead of 1 pump.

In general, the adaptive control set point curve and technique according to the present invention can be used for obtaining an optimal control set point in accordance with any dynamic systems. The performance of pump control together with the hydronic system in operation may be optimized. The operation cost may also be reduced and the energy is saved.

The Apparatus 10

By way of example, the functionality of the apparatus 10 may be implemented using hardware, software, firmware, or a combination thereof. In a typical software implementation, the apparatus 10 would include one or more microprocessor-based architectures having, e.g., at least one processor or microprocessor like element 12, random access memory (RAM) and/or read only memory (ROM) like element 14, input/output devices and control, and data and address buses connecting the same, and/or at least one input processor 18 and at least one output processor 20. A person skilled in the art would be able to program such a microcontroller (or microprocessor)-based implementation to perform the functionality described herein without undue experimentation. The scope of the invention is not intended to be limited to any particular implementation using technology either now known or later developed in the future. The scope of the invention is intended to include implementing the functionality of the processors 12, 14, 16, 18 as stand-alone processor or processor module, as separate processor or processor modules, as well as some combination thereof.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. Apparatus comprising:

at least one processor;

at least one memory including computer program code;

the at least one non-transitory tangible computer readable storage medium or memory and computer program code configured, with at least one processor, to cause the apparatus at least to:

respond to signaling containing information about an instant pressure and a flow rate of fluid being pumped in a pumping system, obtain an adaptive control curve based at least partly on the instant pressure and flow rate using an adaptive moving average filter, set up a control set point for a system process variable from the adaptive control curve to obtain a desired pump speed through a pump control or controller, including a PID control, and determine a pump motor drive speed signal based at least partly on the control set point for the system process variable from the adaptive control curve.

2. Apparatus according to claim 1, where the adaptive control curve, $SAMA_t$, is based at least partly on a system flow equation:

$$SAMA_t = AMAF(Q_t/\sqrt{\Delta P_t}),$$

where the function AMAF is an adaptive moving average filter (AMAF), and the parameters Q and ΔP are a system flow rate and differential pressure respectively.

3. Apparatus according to claim 2, wherein the at least one memory and computer program code are configured, with the at least one processor, to cause the apparatus at least to obtain an optimal control pressure set point from the adaptive control curve with respect to an instant flow rate or a moving average flow rate as $$SP_t = MA(Q_t)/SAMA_t,$$

where the function MA is a moving average filter (MA).

4. Apparatus according to claim 1, wherein the adaptive moving average filter includes using a moving average filter function (MA), or an adaptive moving average filter function to obtain the adaptive control curve, respectively.

5. Apparatus according to claim 1, wherein the at least one non-transitory tangible computer readable storage medium or memory and computer program code are configured, with the at least one processor, to cause the apparatus at least to obtain pump speed using the pump control or controller, including the PID control, with the instant system pressure versus the set point obtained from the adaptive control curve.

6. Apparatus according to claim 1, wherein the at least one non-transitory tangible computer readable storage medium or memory and computer program code are configured, with the at least one processor, to cause the apparatus at least to include a threshold at beginning of the adaptive control curve for accommodating a pump initial speed.

7. Apparatus according to claim 1, wherein the apparatus forms part of the pump control or controller, including the PID controller, and including for use in a heating and cooling water system.

8. Apparatus according to claim 1, wherein the apparatus forms part of a primary control system or a secondary control system.

9. Apparatus according to claim 1, wherein the signaling for obtaining the adaptive control curve includes input processing control signals containing information about system or zone pressures or differential pressures together with system or zone flow rates, or other derivative signals, including as power or torsion.

10. A method comprising:

implementing steps with apparatus comprising at least one processor and at least one non-transitory tangible computer readable storage medium or memory including computer program code, as follows:

responding to signaling containing information about an instant pressure and a flow rate of fluid being pumped in a pumping system;

obtaining an adaptive control curve based at least partly on the instant pressure and flow rate using an adaptive moving average filter;

setting up a control set point for a system process variable from the adaptive control curve to obtain a desired pump speed through a pump control or controller, including a PID control; and determining a pump motor drive speed signal based at least partly on the control set point for the system process variable from the adaptive control curve.

11. A method according to claim 10, where the adaptive control curve is based at least partly on a system flow equation:

$$SAMA_t = AMAF(Q_t/\sqrt{\Delta P_t}),$$

where the function AMAF is an adaptive moving average filter function (AMAF), and the parameters Q and ΔP are a system flow rate and differential pressure respectively.

12. A method according to claim 11, where the at least one non-transitory tangible computer readable storage medium or memory and computer program code are configured to, with the at least one processor, to cause the apparatus at least to obtain an optimal control pressure set point from the adaptive control curve with respect to an instant flow rate or a moving average flow rate as $$SP_t = MA(Q_t)/SAMA_t,$$

where the function MA is a moving average filter function (MA).

13. A method according to claim 10, wherein the adaptive moving average filter includes using a moving average filter function (MA), or an adaptive moving average filter function to obtain the adaptive control curve, respectively.

14. A method according to claim 10, wherein the at least one non-transitory tangible computer readable storage medium or memory and computer program code are configured, with the at least one processor, to cause the apparatus at least to obtain pump speed using the pump control or controller, including the PID control, with the instant system pressure versus the set point obtained from the adaptive control curve.

15. A method according to claim 10, wherein the at least one non-transitory tangible computer readable storage medium or memory and computer program code are configured, with the at least one processor, to cause the apparatus at least to include a threshold at beginning of the adaptive control curve for accommodating a pump initial speed.

16. A method according to claim 10, wherein the apparatus forms part of the pump control or controller, including the PID controller, and including for use in a heating and cooling water system.

17. A method according to claim 10, wherein the apparatus forms part of a primary control system or a secondary control system.

18. A method according to claim 10, wherein the signaling for obtaining the adaptive control curve may include input processing control signals containing information about system or zone pressures or differential pressures together with system or zone flow rates, or other derivative signals, including as power or torsion.

19. Apparatus, including a system having a pump controller, the pump controller comprising:

at least one processor;

at least one non-transitory tangible computer readable storage medium or memory and computer program code configured, with at least one processor, to cause the pump controller at least to:

respond to signaling containing information about an instant pressure and a flow rate of fluid being pumped by a pump in a pumping system, obtain an adaptive control curve based at least partly on the instant pressure and flow rate using an adaptive moving average filter, set up a control set point for a system process variable from the adaptive control curve to obtain a desired pump speed through the pump control or controller, including a PID control, and determine a pump motor drive speed signal based at least partly on the control set point for the system process variable from the adaptive control curve.

20. Apparatus according to claim 1, wherein the apparatus further comprises:

either at least one input processor configured to receive process variable signals, including the signaling containing information about the instant pressure and the flow rate of fluid being pumped in the pumping system; or at least one output processor configured to provide the pump motor drive speed signal; or a combination thereof.

21. A method according to claim 10, wherein the method further comprises:

either receiving in at least one input processor process variable signals, including the signaling containing information about the instant pressure and the flow rate of fluid being pumped in the pumping system; or providing with at least one output processor the pump motor drive speed signal; or a combination thereof.

22. Apparatus according to claim 19, wherein the apparatus further comprises:

either at least one input processor configured to receive process variable signals, including the signaling containing information about the instant pressure and the flow rate of fluid being pumped in the pumping system; or at least one output processor configured to provide the pump motor drive speed signal to the pump; or a combination thereof.

* * * * *